US005477704A

United States Patent [19]

Wright

[11] Patent Number: 5,477,704

[45] Date of Patent: Dec. 26, 1995

[54] REFRIGERANT COOLING ASSEMBLY FOR CENTRIFUGES

[75] Inventor: Herschel E. Wright, Gilroy, Calif.

[73] Assignee: Beckman Instruments, Inc., Fullerton, Calif.

[21] Appl. No.: 363,207

[22] Filed: Dec. 22, 1994

Related U.S. Application Data

[63] Continuation of Ser. No. 309,526, Sep. 20, 1994, abandoned, which is a continuation of Ser. No. 989,278, Dec. 11, 1992, abandoned.

[51] Int. Cl.[6] ..... F25D 25/02

[52] U.S. Cl. ..... 62/381; 62/383

[58] Field of Search ..... 62/381, 386; 165/169; 494/14

[56] References Cited

U.S. PATENT DOCUMENTS

| | | | |
|---|---|---|---|
| 2,317,775 | 4/1943 | King | 62/383 |
| 2,626,228 | 2/1953 | Bergmann . | |
| 2,788,643 | 4/1957 | Martin | 62/395 |
| 2,820,615 | 1/1958 | Peters | 165/169 |
| 3,224,501 | 12/1965 | Burdick et al. . | |
| 3,295,172 | 1/1967 | Dain | 165/169 |
| 3,318,376 | 5/1967 | Vihl . | |
| 4,379,390 | 4/1983 | Bottum | 165/169 |
| 4,452,050 | 6/1984 | Pierce . | |
| 4,512,758 | 4/1985 | Wedemeyer et al. | 494/13 |
| 4,690,669 | 9/1987 | Williams et al. | 62/395 |
| 4,785,637 | 11/1988 | Giebeler | 62/3 |
| 4,984,360 | 1/1991 | Sather et al. . | |
| 5,037,371 | 8/1991 | Romanauskas | 494/10 |

FOREIGN PATENT DOCUMENTS

| | | |
|---|---|---|
| 224238A2 | 11/1986 | European Pat. Off. . |
| 2549214A1 | 7/1984 | France . |
| 3003407A1 | 1/1980 | Germany . |
| 3417574A1 | 5/1984 | Germany . |
| 1182940 | 10/1968 | United Kingdom . |
| 2070744 | 2/1980 | United Kingdom . |
| 2150717 | 11/1984 | United Kingdom . |

*Primary Examiner*—Ronald C. Capossela
*Attorney, Agent, or Firm*—William H. May; Paul R. Harder; Schneck & McHugh

[57] ABSTRACT

An improved configuration of refrigerant tubing and means for attaching the tubing to the centrifuge chamber. The tubing is preformed to provide a flat contact surface against the outside surface of the centrifuge chamber. The centrifuge tubing is tightly wound around the centrifuge chamber in a continuous fashion including a flat spiral at the base of the centrifuge chamber. For the section of the tubing in contact with the vertical cylindrical wall of the centrifuge chamber, the pressure for maintaining contact pressure between the flat surface of the tubing and the chamber wall is provided by the tension in the wrapping of the tubing. For the section of the tubing at the base of the centrifuge chamber, contact pressure may be provided by a clamping mechanism. To further enhance heat transfer between the refrigerant coils and the centrifuge chamber, a high heat conductive epoxy may be applied between the tubing and the centrifuge chamber surface. Due to the tight winding of the tubing and the flat contact surface between the refrigerant tubing and the chamber wall, there is optimum use of surface area for maximum and efficient heat transfer between the chamber and the tubing.

5 Claims, 4 Drawing Sheets

REFRIGERANT COOLING ASSEMBLY FOR CENTRIFUGES

This is a continuation of application Ser. No. 08/309,526 filed on Sep. 20, 1994 now abandoned, which is a continuation of application Ser. No. 07/989,278 filed on Dec. 11, 1992 now abandoned.

BACKGROUND OF THE INVENTION

1. Field of the Invention

The present invention relates to cooling system for centrifuges, and more particularly to an improved refrigerant cooling coil assembly for a centrifuge chamber.

2. Description of Related Art

Centrifugation generally involves rotating a sample solution at high speed about an axis to create a high centrifugal field to separate the sample into its components based upon their relative specific gravity. Referring to FIG. 1, the sample is carried in a rotor 10 which is placed in a centrifuge chamber 12 in a centrifuge instrument. The rotor 10 is driven to rotate at high speed by a motor 14 beneath the centrifuge chamber 12. At high speed operations, e.g. greater than 10,000 rpm, aerodynamic drag on the rotor becomes significant. Significantly more power is required to overcome the aerodynamic drag at high speed. In addition, cooling means should be provided to offset the heat generated by aerodynamic friction. Some centrifuges are provided with means for drawing a vacuum or partial vacuum in the Centrifuge chamber in an effort to reduce the aerodynamic drag; however, cooling is still essential.

In the past, cooling of the centrifuge chamber has been accomplished by attaching refrigerant coils to the outside of the centrifuge chamber. Referring to FIGS. 1 and 2, two prior art methods of attaching the refrigerant coils are shown. In FIG. 1, the refrigerant "coils" are in the form of passages 16 formed by welding a corrugated sleeve 18 around the centrifuge chamber 12. (The size of the corrugations are exaggerated in the illustration.) A refrigeration unit 17 circulates refrigerant through the passages 16 between the sleeve 18 and the outside wall of the centrifuge chamber 12. In this prior art configuration, a space must be provided between adjacent passages to allow for welding (e.g. at 19 and 20) which reduces available surface area for efficient heat transferred from the chamber.

In FIG. 2, circular refrigerant tubing 22 is soldered to the outside wall of the centrifuge chamber 12. Adjacent sections of the tubing 22 are spaced apart to provide clearance for applying solder 23. (The size and spacing of the tubing is exaggerated in the illustration.) This spacing reduces the surface area that is available for heat transfer. In addition, differences in thermal expansion and contraction between the centrifuge chamber, the refrigerant tubing and the solder material may cause fracture in the solder joint thereby reducing the contact between the refrigerant tubing and the wall of the centrifuge chamber 12.

SUMMARY OF THE INVENTION

The present invention is directed to an improved configuration of refrigerant tubing and means for attaching the tubing to the centrifuge chamber. The tubing is preformed to provide a flat contact surface against the outside surface of the centrifuge chamber. The centrifuge tubing is tightly wound around the centrifuge chamber in a continuous fashion including a flat spiral at the base of the centrifuge chamber.

For the section of the tubing in contact with the vertical cylindrical wall of the centrifuge chamber, the pressure for maintaining contact pressure between the flat surface of the tubing and the chamber wall is provided by the tension in the wrapping of the tubing. For the section of the tubing at the base of the centrifuge chamber, contact pressure is provided by a clamping mechanism. To further enhance heat transfer between the refrigerant coils and the centrifuge chamber, a high heat conductive epoxy may be applied between the tubing and the centrifuge chamber surface. In accordance with the present invention, neither soldering nor welding of the tubing to the chamber is required. Due to the tight winding of the tubing and the flat contact surface between the refrigerant tubing and the chamber wall, there is optimum use of surface area for maximum and efficient heat transfer between the chamber and the tubing.

DESCRIPTION OF ILLUSTRATED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims.

Figure 1:
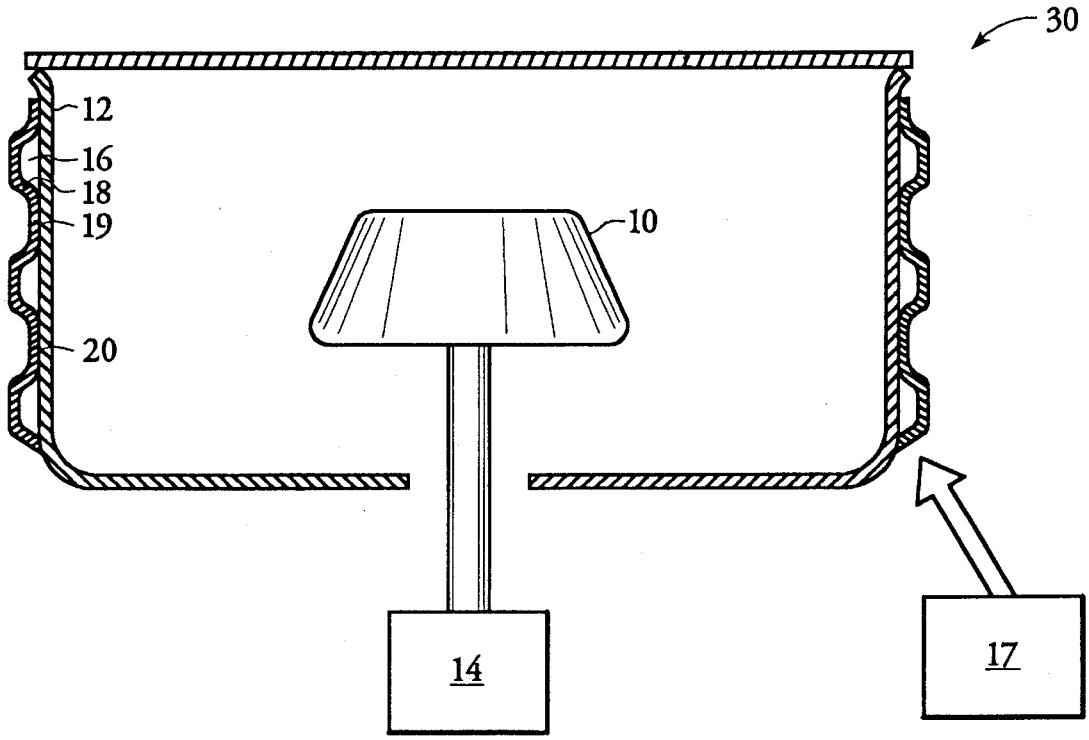
FIG. 1 (PRIOR ART)
FIG. 1 is a simplified sectional view of a prior art centrifuge showing the use of corrugated refrigerant passages for cooling of the centrifuge chamber.
Figure 2:
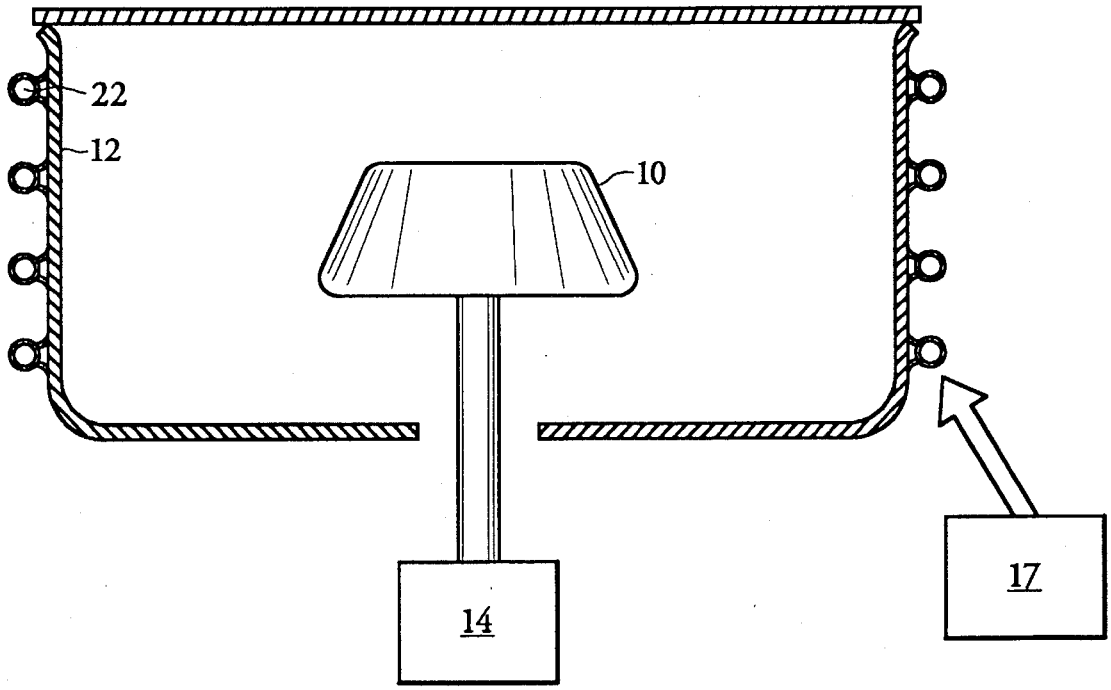
FIG. 2 (PRIOR ART)
FIG. 2 is a simplified sectional view of a prior art centrifuge showing the use of circular tubing for refrigerant cooling of the centrifuge chamber.
Figure 3:
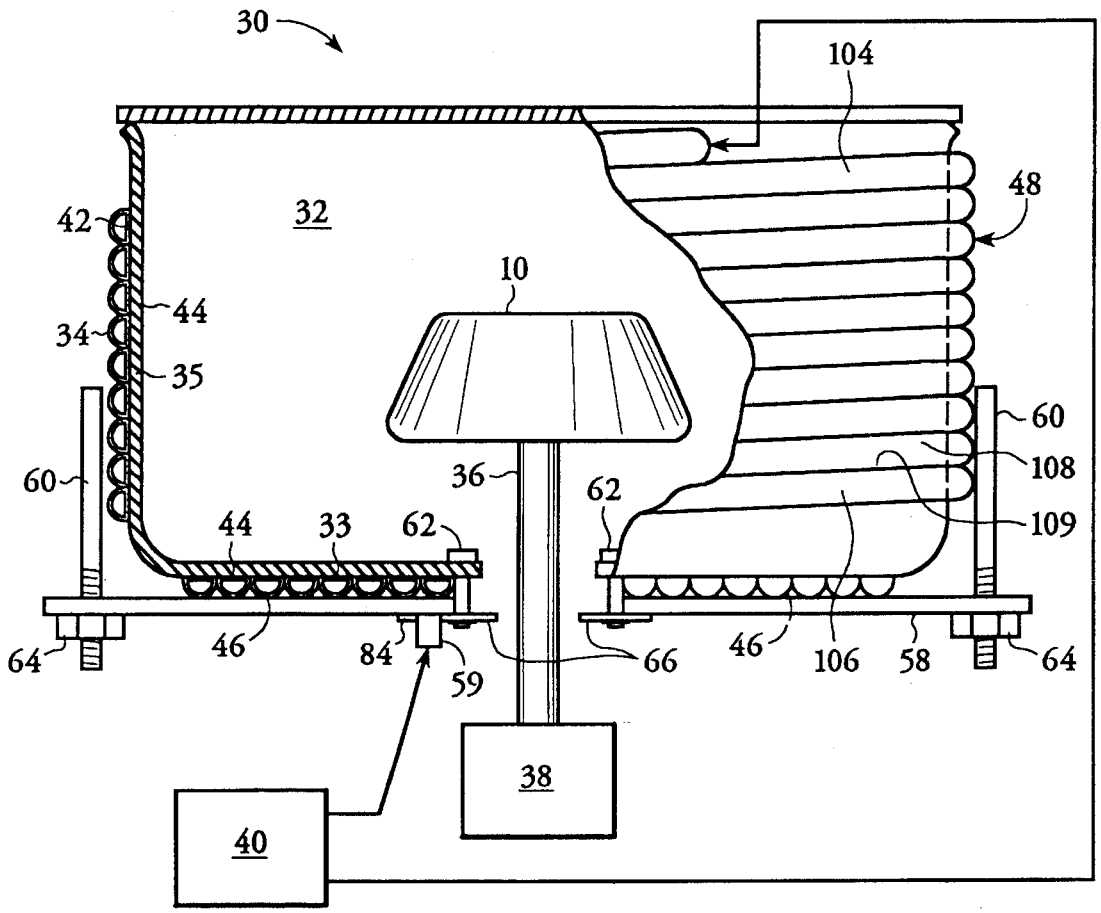
FIG. 3 is a partial sectional view of a centrifuge showing the use of refrigerant tubing assembly for cooling the centrifuge chamber configured in accordance with one embodiment of the present invention.

FIG. 3 shows a centrifuge system 30 having a cylindrical metal (e.g. stainless steel) centrifuge chamber 32 to which a refrigerant tubing 34 is attached to its cylindrical sides 35 (windings 48) and flat base 33 (windings 46) for cooling during centrifugation. The size of the tubing 34 is exaggerated for illustration purpose. The chamber 32 is partially broken away to show the centrifuge rotor 10 which is supported on a shaft 36 driven by a motor 38. The ends of the tubing 34 are connected to an appropriate refrigeration device 40 which circulates a suitable coolant or refrigerant through the tubing.

Figure 4A:
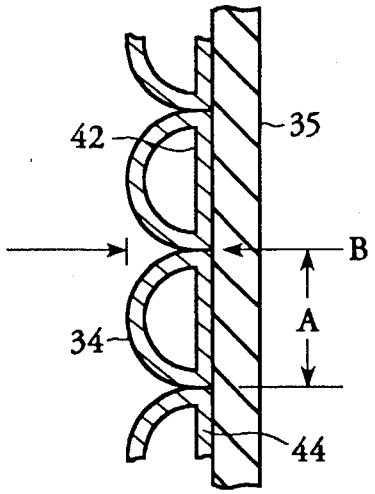
FIG. 4A is an enlarged sectional view showing the cross-section of the refrigerant tubing and attachment to the centrifuge chamber in accordance with the present invention.
Figure 4B:
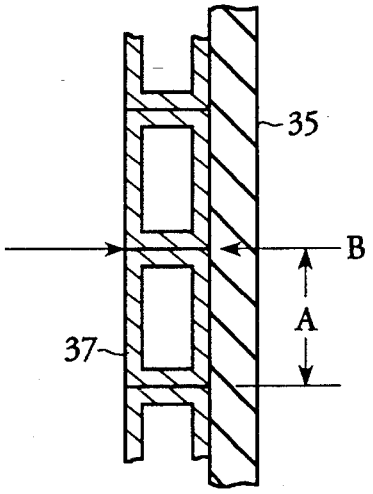
FIG. 4B is an enlarged sectional view showing the cross-section of the refrigerant tubing in accordance with another embodiment of the present invention.

The cross-section of the tubing 34 is more clearly shown in FIG. 4A, which in this particular embodiment has a generally D-shaped cross-section (resembling a somewhat semi-elliptical cross-section). The contact surface 42 of the tubing 34 against the chamber wall 35 and base 33 is essentially flat (in cross-section). A thin layer of high heat conductive epoxy 44 may be applied to improve the surface contact between the tubing 34 and the chamber 32. As will be described in greater detail below, the tubing 34 is preformed with the desired cross-section from circular tubing stock prior to winding on the centrifuge chamber. A suitable tubing stock for a 0.46 m (1.5 ft) diameter chamber is 1.9 cm (0.75 inch) O.D., 0.138 mm (0.035 inch) thickness thin wall refrigeration grade soft copper tubing which is commercially available from a number of suppliers. Tubing 37 having a rectangular (including square) cross section may be used instead (see FIG. 4B).

It is noted that while a flat contact surface 42 on the tubing 34 is efficient for heat transfer between it and the chamber wall 35, there should be sufficient flow cross-section behind the contact surface 42 to allow sufficient flow of refrigerant to efficiently carry heat away from the contacting surface 42. The aspect ratio of the cross-section (FIG. 4A), i.e. the sectional dimension A of the contact surface divided by the sectional linear dimension B orthogonal to the contact surface (i.e. A/B), should be between 1 (a circle or square) and 2.0, preferably about 1.7. It is noted that in the case of a semi-elliptical cross-section, except for the rounded corners of the flat surface 42 the sectional dimension A of the flat surface 42 is larger than any other linear dimension between any two points in the cross-section.

Referring again to FIG. 3, in order to secure the windings 46 against the chamber base 33, a thin circular retainer plate 58 (about 2.5 mm thick) is used to bias or clamp the spiral windings 46 against the chamber base 33. Anchors are provided about the retainer plate 58 for applying an uniform pressure on the flat spiral windings 46. Specifically, threaded studs 60 are soldered or welded to the windings 48. Another set of threaded studs 62 are anchored to the chamber base 33 and passed through the inside of the spiral windings 46 and a plate 59 on which nuts 66 are fastened. The pressure applied on the windings 46 depends on the extent of tightening of the nuts 64 and 66 with respect to the threaded studs 60 and 62.

The fabrication procedure will now be discussed. Preferably, the windings 46 at the chamber base 33 and the windings 48 around the chamber sides 35 should be from a single continuous tubing. This is to avoid having to join two sections of tubing, e.g. by welding or soldering, which would otherwise reduce reliability. It has also been determined that the overall cost involved in the assembling of the tubing onto the centrifuge chamber is less for the continuous winding and assembling process described below than would be for a process of separately forming the windings 46 and 48 followed by assembling of the windings and associated braces.

Figure 5:
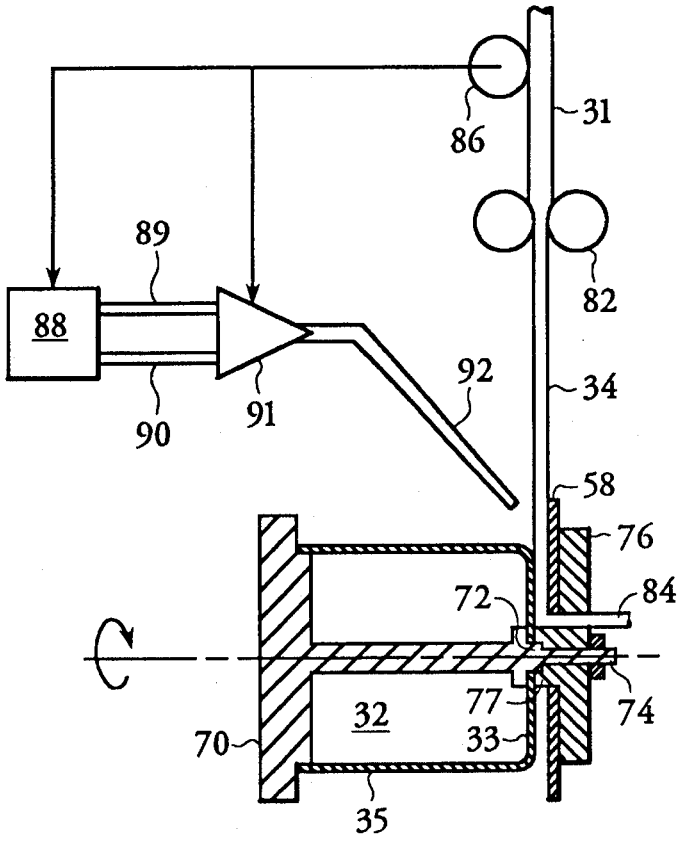
FIG. 5 illustrates schematically the forming of the flat spiral windings for the base of the centrifuge chamber.
Figure 6:
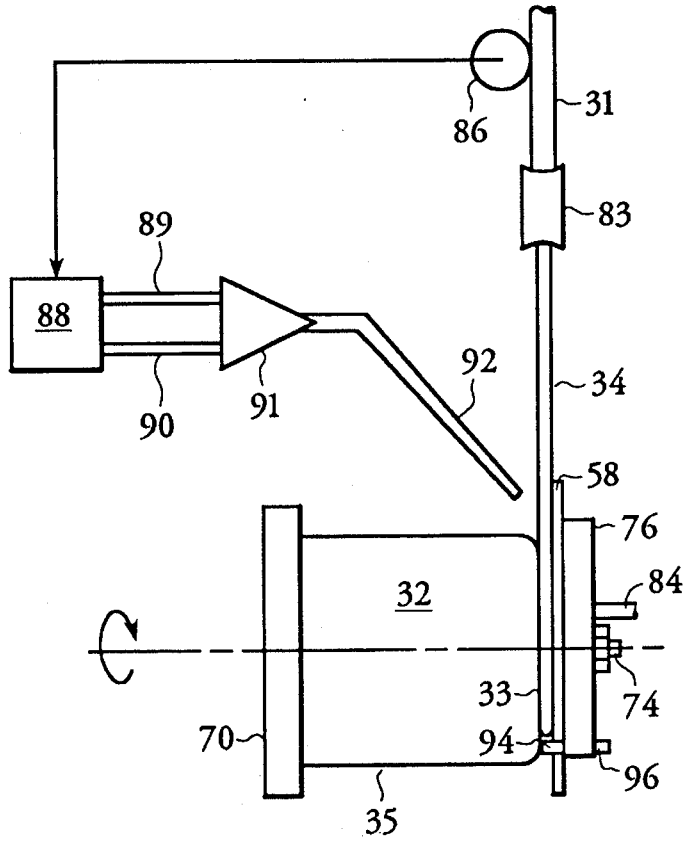
FIG. 6 illustrates the transition from the spiral windings to the circumferential windings.

The tubing 34 is first wound into a flat spiral with the flat surface of the tubing lying in a plane against the chamber base 33, and then it is wound circumferentially around the chamber wall 35. Referring to FIGS. 5 and 6, the continuous winding process is schematically illustrated. Specifically, the centrifuge chamber 32 is set up on a lathe (not shown) by axially supporting it using spindle 70 (schematically shown) for rotation about the chamber axis. The spindle 70 has a centering stub 72 which fits through the opening in the base 33 of the chamber 32, and a threaded end 74 which extends from the stub 72. The retainer plate 58 having a central opening is supported against a rigid support plate 76 within the confines of the flange. The support plate 76 has a central hub 77 which extends through the central opening in the support plate 76 and mates with the stub 72 on the spindle 70. The height of the nub above the support plate is equal to the thickness of the retainer plate 58 and the thickness (dimension B) of the spiral windings 46. The diameter of the nub 77 is the inner diameter of the spiral windings 46 to be formed. A nut 80 is threaded onto the threaded end 74 of the spindle 70 to tighten the support plate 76 against the chamber base 33 as shown in FIG. 5, leaving a space of width B between the retainer plate 58 and the chamber base 33.

The circular tubing stock 31 is fed through appropriate extrusion rollers 82 to preform tubing 34 with a flat surface 42 (as shown in FIG. 4A) facing the chamber base 33. The end 84 of the tubing 34 is bent and passed through a hole provided on the retainer plate 58 and support plate 76. This end 84 is thus secured for initiating winding of the tubing 34. The chamber 32 is rotated slowly to tow the tubing 34 under tension and wind it around the nub 77 of the support plate 76 to form a flat spiral. At the same time, epoxy is automatically dispensed to the flat surface 42 of the tubing 34. Specifically, a drive wheel 86 is coupled to the tubing 31 ahead of the roller 82, which drives a proportioning pump 88 to dispense an epoxy resin 89 and a catalyst 90 into a mixing chamber 91 where the resin 89 and catalyst 90 are mixed. At the same time, previously mixed epoxy in the mixing chamber 90 is dispensed to the tubing 34 through applicator tube 92. A suitable epoxy for use to glue copper tubing to a stainless steel chamber is aluminum filled "F-2" epoxy manufactured by Devcon Company.

Figure 7:
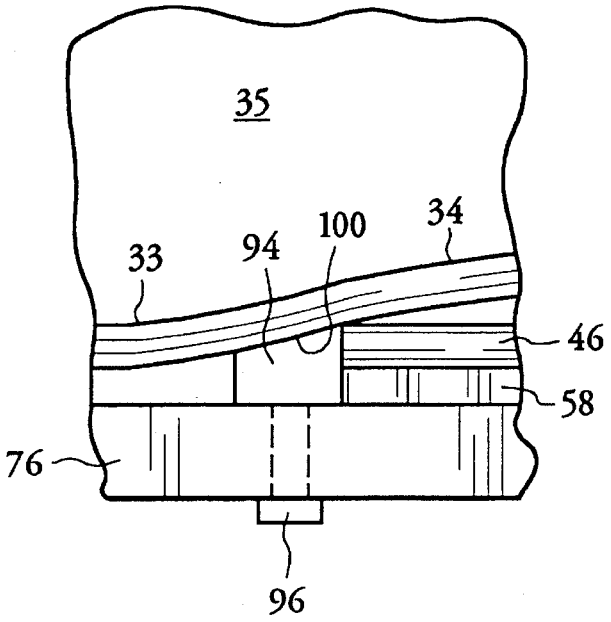
FIG. 7 is a side view of the wedge for deflecting the tubing from the spiral windings to the circumferential windings.
Figure 8:
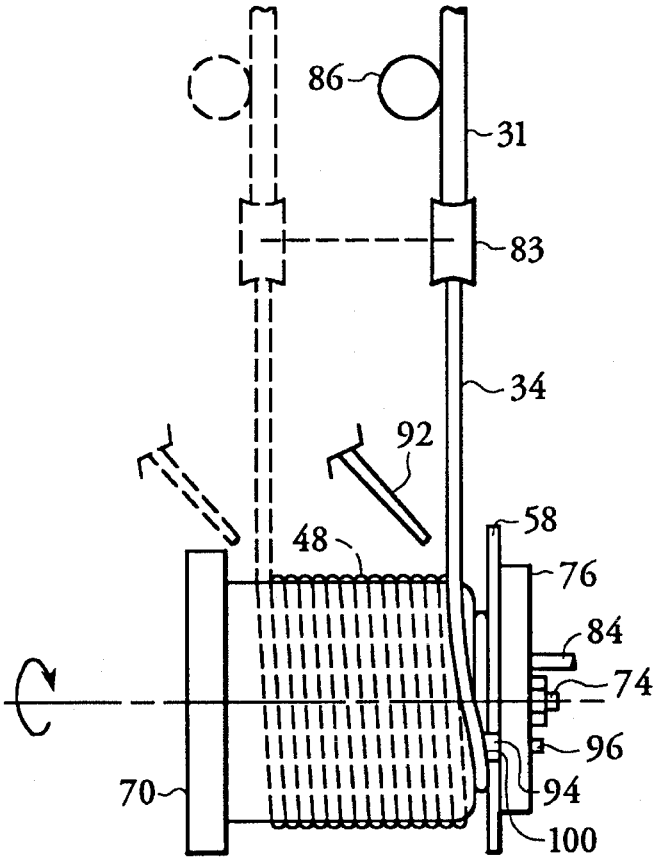
FIG. 8 illustrates schematically the forming of the circumferential windings around the cylindrical sides of the centrifuge chamber.

It can be seen that the spiral windings 46 is confined to the space between chamber base 33 and the retainer plate 58. The tension in the tubing 34 causes the spiral to be tightly wound. Rotation of the chamber 32 is continued until thee last winding before the transition to the circumferential windings 48. Rotation is stopped and a wedge 94 is installed on the support plate 76 using a bolt 96 (see FIG. 6). The retainer plate 58 has a cutout 98 which accommodates the wedge 94. Referring to FIGS. 7 and 8, the wedge 94 has a ramp 100 that slopes down towards the direction of rotation of the chamber 32 (see arrow). Rotation of the chamber 32 is continued whereby the ramp 100 deflects the tubing 34 to the chamber side wall 35 of the chamber 32 as shown in FIGS. 7 and 8.

It is noted that the roller 82 has to be replaced with another set of rollers 83 (configured orthogonal to the rollers 82) appropriate for preforming the tubing 31 with a flat surface facing the chamber wall 35. The change from the rollers 82 to rollers 83 should be executed prior to the transition from the spiral windings 46 to the circumferential windings 48, and the timing therebetween can be determined by experiments by taking into account the length of tubing to be taken up in the spiral windings 46 prior to the wedge 94. The roller 83 is supported by conventional means not shown to translate parallel to the chamber axis so as to feed the tubing 34 as it is wound onto the chamber wall 35.

FIG. 8 illustrates wrapping of the refrigerant tubing 34 around the cylindrical side wall 35 of the chamber 32 while epoxy is being applied to the flat surface 42 of the tubing as before. The pump 88 and associated epoxy dispensing hardware are not shown for simplicity. Alternatively, a thin layer of epoxy may be spread on the cylindrical outside surface of the chamber 32 prior to winding. The centrifuge chamber 32 is slowly rotated to cause the tubing 34 to be wound in a tight helical fashion about the chamber 32. The tubing 34 is towed under tension so as to cause the tubing to tightly wrap against the chamber sides 35.

At the end of the circumferential windings process but before the support plate is removed, the free end 102 of the tubing 34 is soldered to the adjacent winding 104 (at 105, see FIG. 3) to hold the tension in the windings and prevent the windings from coming loose under tension. The first and second windings 106 and 108 from the transition from the chamber base 33 are also soldered together (at 109, FIG. 3). The studs 60 are soldered to the circumferential windings 48 and the nuts 64 are fastened to the studs 60 to cause the retainer plate 58 to hold the spiral windings 46 in place. The support plate 76 is then removed by unlocking the nut 80. The studs 62 are affixed through the chamber base 33 and the plate 59 (FIG. 3), and the nuts 66 fastened to complete the assembly. The entire assembly is placed in an oven to cure the epoxy at 100° C. for 20 minutes.

It can be seen that the retainer plate 58 functions as a guide for the spiral windings 46. The support plate 76 provides the necessary support to the retainer plate 58 which otherwise might flex during the winding process.

Referring back to FIGS. 3 and 4, it is noted that the adjacent windings of the tubing 34 are adjoining to allow for maximum coverage of tubing around the chamber 32. On any given surface area of the chamber 32, maximum packing of tubing windings can be achieved by eliminating inter-winding spacings. This is possible because soldering of the tubing to the chamber is not contemplated, therefore no spacing between adjacent windings need to be provided to otherwise allow for soldering operations. The flat contact surface 42 provides a larger area of maximum and efficient heat transfer with respect to the flat wall of the chamber, as compared to a curved contact surface of a tubing having a circular cross-section. Since the chamber 32 is covered with tubing windings at tight spacing and the tubing has a flat contact surface against the chamber wall, maximum heat transfer between the chamber and the refrigerant in the tubing is achieved for any chamber size. There is little effect from thermal fatigue in the absence of welding or soldering of dissimilar metals of the tubing and chamber.

While the invention has been described with respect to the illustrated embodiment in accordance therewith, it will be apparent to those skilled in the art that various modifications and improvements may be made without departing from the scope and spirit of the invention. Accordingly, it is to be understood that the invention is not to be limited by the specific illustrated embodiment, but only by the scope of the appended claims.

I claim:

1. A centrifuge system comprising:

a chamber having a base and a sidewall with an exterior surface;

means for supporting and rotating a centrifuge rotor in the chamber;

a single continuous length of tubing forming both a spiral winding against said base and a helical winding around said sidewall of the chamber, said tubing containing a flow of a coolant, both said spiral winding and said helical winding arranged in such closely packed relation that adjacent windings of said tubing adjoin one another with substantially no inter-winding spacing between said tubing, a substantially flat surface of the tubing being in contact with said base and said sidewall on the exterior surface of the chamber;

means for maintaining tension on said windings so as to hold said tubing firmly against said base and said sidewall, said tension maintaining means including biasing means for applying a substantially uniform bias pressure to said spiral winding so as to clamp said spiral winding against said base, said biasing means including a retainer plate parallel to and spaced apart from said base with said spiral winding being located between said retainer plate and said base, said tension maintaining means further including solder connections at both ends of said helical winding, said solder connections being between adjoining portions of tubing in said helical winding; and means for circulating a coolant through the tubing for cooling the chamber.

2. A system as in claim 1 wherein the ratio of the dimension of the flat sectional surface of said tubing to the dimension of the cross-section of the tubing orthogonal to said flat section surface is between one and two.

3. A system as in claim 2 wherein the tubing has a substantially semi-circular or semi-elliptical cross-section.

4. A system as in claim 2 wherein the flat sectional surface of said tubing is at least substantially as large as the linear dimension between any two points in the cross-section.

5. A system as in claim 2 wherein the tubing has a rectangular cross-section.

* * * * *